United States Patent [19]

Kelley

[11] 4,091,628

[45] May 30, 1978

[54] PRESTRESSED ELASTIC ARCHED MINE ROOF SUPPORT

[76] Inventor: Jay Hilary Kelley, 3292 University Ave., Morgantown, W. Va. 26505

[21] Appl. No.: 772,015

[22] Filed: Feb. 25, 1977

Related U.S. Application Data

[63] Continuation-in-part of Ser. No. 727,024, Sep. 27, 1976, abandoned.

[51] Int. Cl.[2] ..... E21D 19/00

[52] U.S. Cl. ..... 61/45 C; 61/45 R; 61/63

[58] Field of Search ..... 61/45 C, 45 B, 45 R, 61/42, 84, 85, 63; 299/11, 10, 31-33

[56] References Cited

U.S. PATENT DOCUMENTS

| | | | |
|---|---|---|---|
| 730,677 | 6/1903 | Marcus | 61/84 |
| 1,229,323 | 6/1917 | Roby | 61/84 X |
| 1,451,840 | 4/1923 | Novotny | 61/45 C |
| 2,398,130 | 4/1946 | Beij | 61/45 B |
| 2,510,593 | 6/1950 | Mechling | 61/45 C |
| 2,667,037 | 1/1954 | Thomas et al. | 61/45 B |
| 2,682,152 | 6/1954 | Bierer | 61/45 B |

FOREIGN PATENT DOCUMENTS

| | | | |
|---|---|---|---|
| 2,429,805 | 1/1976 | Germany | 61/45 C |
| 1,227,317 | 4/1971 | United Kingdom | 61/45 C |
| 1,175,061 | 12/1969 | United Kingdom | 61/45 C |
| 262,051 | 11/1970 | U.S.S.R. | 61/45 C |

*Primary Examiner*—Dennis L. Taylor
*Attorney, Agent, or Firm*—Thomas H. Murray

[57] ABSTRACT

An arched roof support for a mine opening essentially includes an elastic plate member with a preselected curvature across its length employed for establishing a prestressed emplacement into a load-bearing contact along the middle portion of the roof stratum of the mine opening. The material forming the plate member is selected for withstanding an elastic deformation force to maintain the prestressed emplacement which is effected by the elevated support of one or both sides of the plate member along or toward side ribs of the mine opening. As anchoring means, the side edges of the plate member are either supported solely by the ribs of the mine opening or additional support is supplied by roof bolts, rib bolts or props having an adjustable length. A hydraulic or mechanical actuator is used to elevate one or both side edges of the plate member to its emplacement elevation whereby the side edges have been raised to between two-thirds to three-quarters of the height of the mine opening or at the roof surface. In a further embodiment, roof bolts are used solely for the prestressed emplacement of an elastic plate member onto the roof stratum or side rib. The pre-formed shape of the elastic arched plate is parabolic, elliptical or a combination of convex and concave configurations. Apparatus for producing the pre-formed shape of the plate is disclosed as well as various forms of anchor means and support props.

14 Claims, 13 Drawing Figures

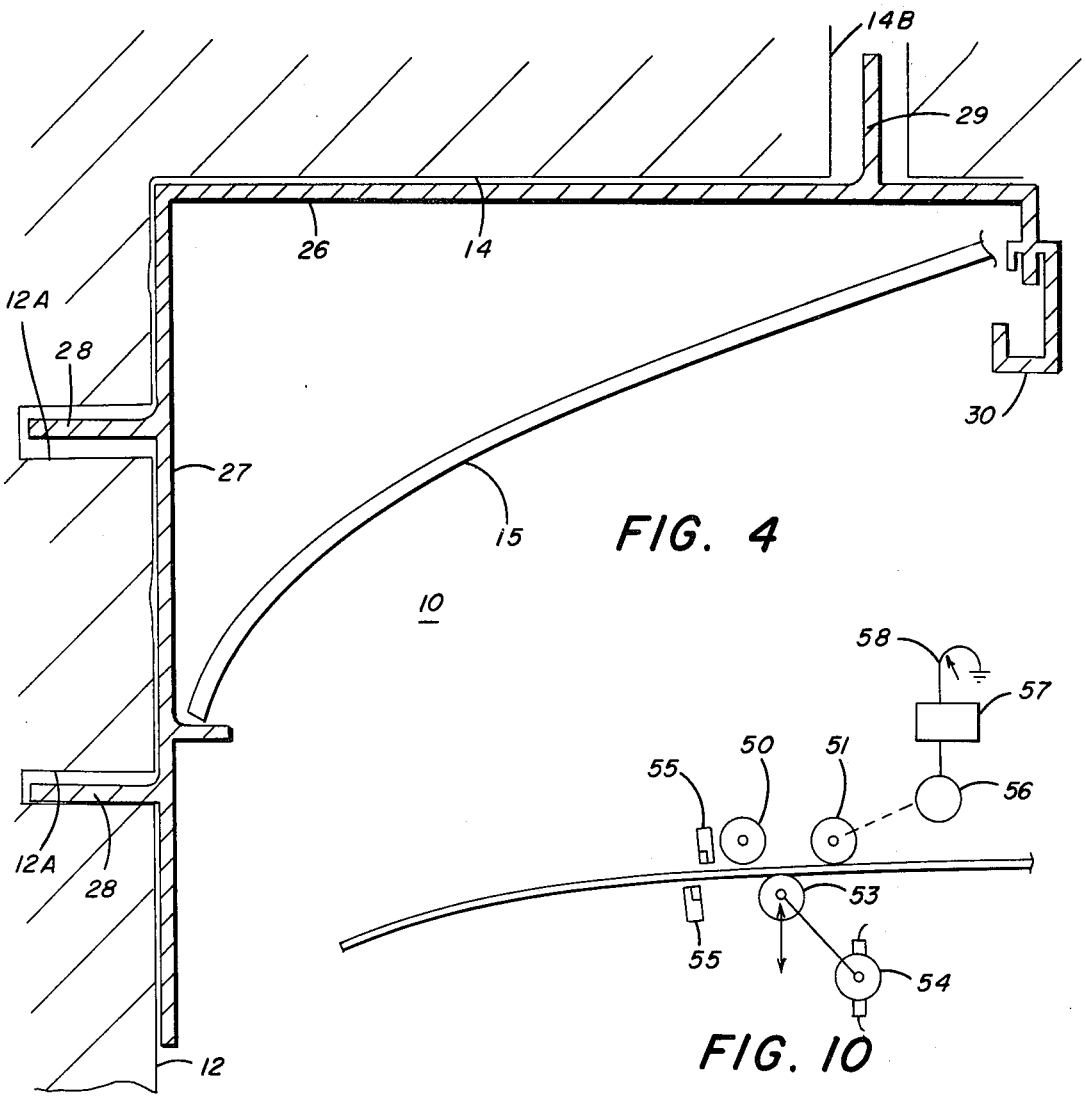
FIG. 4
FIG. 10
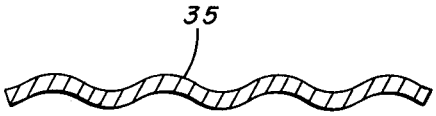
FIG. 5
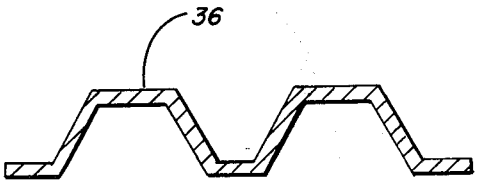
FIG. 6

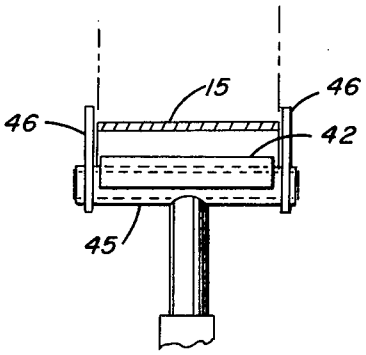
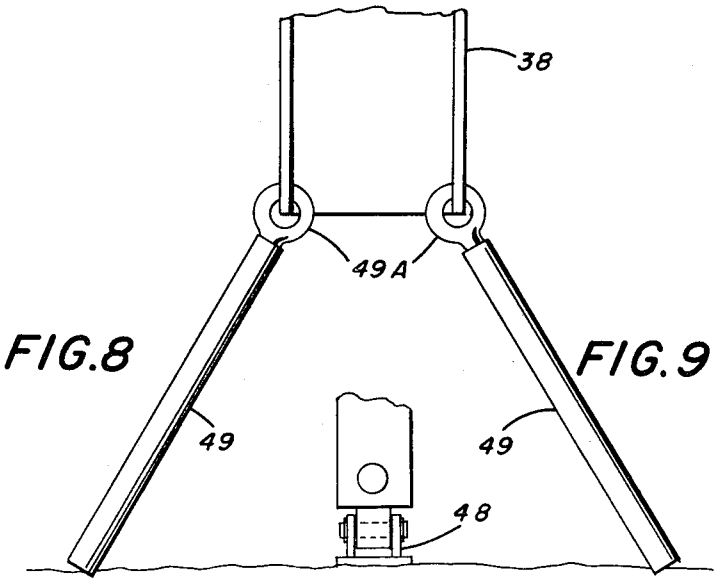
FIG. 9
FIG. 8
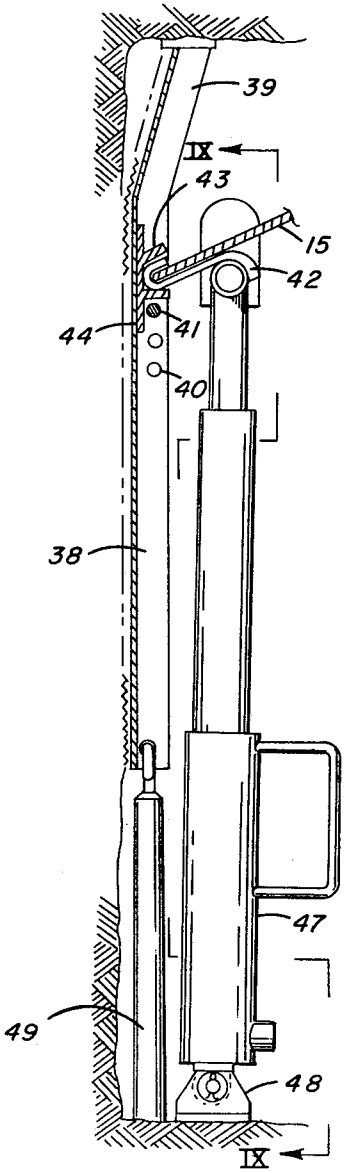
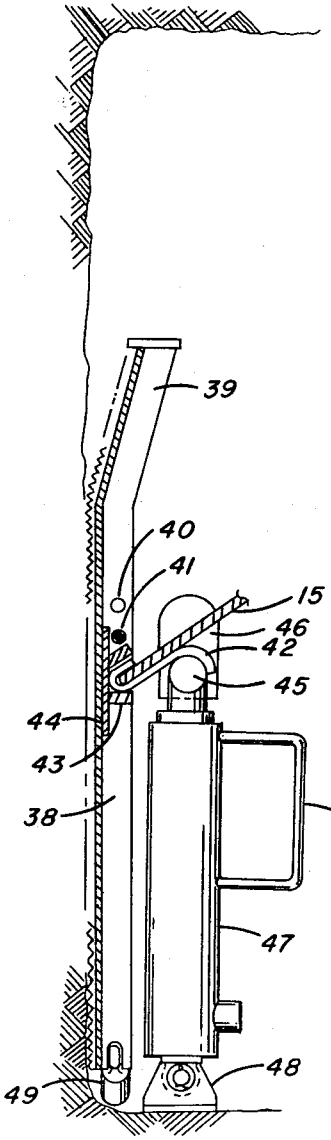
FIG. 7

PRESTRESSED ELASTIC ARCHED MINE ROOF SUPPORT

CROSS-REFERENCE TO RELATED APPLICATIONS

This application is a continuation-in-part of application Ser. No. 727,024, filed Sept. 27, 1976, now abandoned.

BACKGROUND OF THE INVENTION

This invention relates to an arched roof support for a mine opening with a pre-formed shape which is straigtened somewhat to provide prestressing upon emplacement for uniform support of the roof or side rib in a mine opening where the support member makes contact. More particularly, the present invention relates to such an arched roof support together with means for providing the arched configuration of the roof support, means for emplacement of the roof support as well as means for maintaining the support in the emplaced location.

As is known in the art, mine openings have been supported in the past by timers, concrete, metallic structures and more recently by roof bolts. Because these support devices are of such a well-known character, it is deemed unnecessary to set forth a detailed explanation thereof. Experimental devices have been developed for supporting the entries of mine openings wherein these devices take the form of mobile roof supports that are hydraulically operated. Other suggested measures include the use of plastic adhesive to impregnate the roof strata, or using shotcrete or coating techniques for protecting roof strata from moisture and oxygen. However, these measures are only partially effective in supporting rock strata. In recent years, longwall mining techniques brought about the use of roof chocks and roof shields. These devices are self-advancing hydraulically to hold the roof in the immediate area of the longwall mining machine away from the machine as well as the operators therefor.

As mine openings are developed into deeper strata, the pressure becomes increasingly severe to the extent that experience with such mine operations reveals the development of a far greater number of rib "bumps" and other failures of the rib. The heavy pressures on the rib line tend to spall off the vertical wall thereby the vertical wall appears to behave as a plastic material in failure. Also, as mines are opened into seams characterized by weaker roofs, ribs and bottoms, existing types of roof supports will be even less satisfactory. Known existing types of roof supports fail to solve all the problems presented by present-day mining operations. The more costly types of roof supports, such as reinforced concrete and longwall shields, are quite effective but, at the same time, have the acute disadvantage of excessive cost. The high cost of a roof support in longwall mining operations can usually be tolerated because the roof support elements are not lost but, instead, the elements are advanced as the mining operations proceed on the longwall face. Thus, these elements can be used over and over again. However, in the case of room and pillar mining procedures, expendable roof support techniques are commonplace and the short usable life of the panel entries or pillar splits usually do not warrant the cost of expensive roof support devices. A relatively small amount of coal is recoverable from the dispersed openings of the room and pillar mining operations and this severely limits the economical feasibility of roof supports. For these types of mining operations, a serious need exists for an inexpensive but effective roof support.

SUMMARY OF THE INVENTION

It is an object of the present invention to provide a roof support in the form of an elastic prestressed arched member which is relatively inexpensive but extremely effective to support but only the stratum of the roof but also serves to support the rib of the mine opening.

It is another object of the present invention to provide an arched roof support through the use of a preformed plate of high tensile material which is emplaced against the middle portion of the roof while the side edges of the plate are anchored against the rib at an elevation preferably of two-thirds to three-quarters of the ceiling height.

It is a further object of the present invention to provide an elastic arched plate having a pre-formed curvature for emplacement by supporting one edge of the plate by one rib and then raising the opposite edge of the plate along the opposite rib to a height sufficient to impart a precalculated bending stress which includes an arched prestress selected to produce a resulting force angle of less than 30°.

It is a further object of the present invention to provide an elastic plate having a pre-formed curvature for prestressed emplacement along a section of a mine roof by means such as a roof bolt at each end.

It is a further object of the present invention to provide an elastic plate having a pre-formed curvature for prestressed emplacement along a section of a side rib of rib in a mine by means such as roof bolt at each end.

According to the present invention, there is provided an arched roof support comprising a plate member having a preselected curvature across the width thereof essential to establishing a prestressed emplacement into load-bearing contact along the middle portion of the roof stratum of the mine opening, the plate member being capable of withstanding an elastic deformation force to maintain the prestressed emplacement by elevated support of at least one side edge of the plate member along a side rib, and means to elevate one side edge of the plate member along a side rib for at least partial support of the plate member by the side ribs or the plate member being maintained in a prestressed emplacement by roof bolts or rib anchors at one or both side edges.

The side edges of an arched roof support plate member are carried by various different means including supporting the side edges within slotted openings formed in the rib walls, using roof bolts for the emplacement or using an intermediate member in the form of anchor means to support the side edges of the plate member. The anchor means may include ratchet teeth along a face surface thereof to facilitate gripping and retaining the side edges of the plate. Bars may also extend from the anchor means to project into suitably provided openings in the side ribs. A mechanical or hydraulic actuator is used to elevate one or both edges of the plate member and post members with adjustable lengths may, if desired, by installed between the side edge of the plate member and the floor of the mine opening. Conduit means extend along the face surface of the plate member which is directed to the open space between the preselected curvature of the plate member and the roof to the mine opening. The last-named means is suitably formed to provide a ventilation duct or a duct for carrying transmission lines for power and/or communications. When roof bolts are used for the prestressed emplacement of an elastic arched support plate upon either a roof surface or the side rib, then the support plate member preferably takes the form of a narrow elongated arched plate.

These features and advantages of the present invention as well as others will be more fully understood when the following description is read in light of the accompanying drawings, in which:

FIG. 4 is an elevational view similar to FIG. 1 but illustrating a modification of the arched support roof apparatus according to the present invention;

FIGS. 5 and 6 illustrate two different cross-sectional configurations of arched roof supports;

FIG. 7 is an enlarged elevational view of apparatus in an initial set-up position for emplacement of the arched roof support;

FIG. 8 is a view similar to FIG. 7 but illustrating the emplaced position of the roof support and apparatus therefor;

FIG. 9 is a sectional view taken along line IX—IX of FIG. 8;

FIG. 10 illustrates one form of apparatus for forming the arched roof support member according to the present invention;

Figure 1:
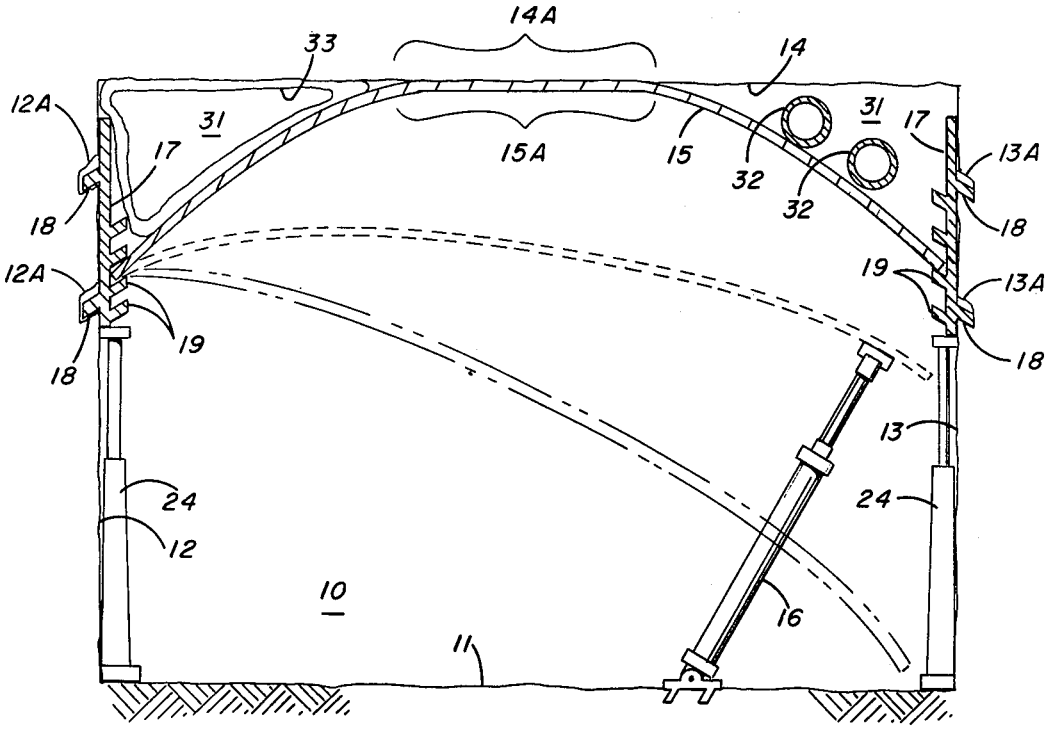
FIG. 1 is an elevational view showing the elastic arched roof support of the present invention emplaced in a mine opening.
Figure 2:
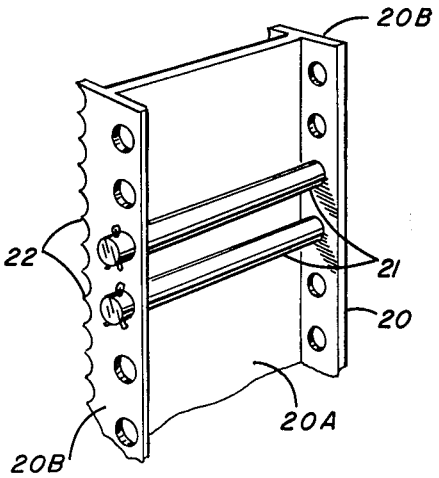
FIG. 2 is a perspective view of a beam-like anchor forming part of the arched roof support apparatus of the present invention.

In FIG. 1, there is illustrated a mine opening 10 defined by a floor 11, upstanding side ribs 12 and 13, and an overlying stratum forming a roof surface 14. A preformed elastic arched roof support plate 15 has a preselected length which may, for example, be 16 feet or some other desired length selected for installation within the mine opening 10. For example, it is preferred to employ a stock pile of various plate lengths of 6-inch intervals to select the length of the support plate within a range of 18 or 24 inches. Color coding the plate lengths will enhance the selection process. The actual width of the plate in an unbent condition exceeds the distance between the side ribs of the mine opening. However, the arched configuration of the plate provides that the distance between the terminal edges essentially corresponds to the width of the mine opening. The arched roof support plate 15 is actually an elastic arch which consists of material having a high tensile strength. Suitable materials include a hardened carbon steel, alloy steel, high quality aluminum alloy, glass reinforced plastic, ferrous and non-ferrous titanium alloy metal and ferrous and non-ferrous magnesium alloy metal. A critically important property of the plate forming the elastic arch is that the material must have sufficient strength under compression to prevent buckling and, at the same time, the material must be capable of producing a sufficient prestress so as to exert a uniform force against the roof along the middle portion section 14A. A combined prestressed and compression arch is necessary because a purely compressive arch would impart no vertical force components upon the middle portion section 14A of the roof. Therefore, the central beam portion 15A of the plate, when emplaced, is under a prestressed force. The compressive arch feature is necessary and important because it provides a large horizontal thrust against the side ribs 12 and 13 so as to permit the development of a sufficient vertical force from the anchor points to provide support for the plate by the side ribs. The horizontal thrust also supports the ribs. The arched roof support made from preformed high tensile material is pressed against the roof by lifting the side edges of the plate along the side ribs 12 and 13 to a height of at least two-thirds and even as much as three-quarters of the ceiling height. When emplaced, the support plate is anchored to a side rib by one of several means. Several procedures and apparatus may be used to effect the emplacement of the arched roof support. One or more piston and cylinder assemblies 16 anchored to the floor 11 may be used to elevate one or both side edges of the arched roof support for emplacement. Other means for this purpose include a pneumatic actuator or a mechanical lifting device such as a screw jack. The arched roof support is emplaced with sufficient force to provide a uniform load across the middle portion of the roof. As shown in FIG. 1, each side ribs 12 and 13 carries a side of the arched roof support through the use of an anchor plate 17. Plate 17 includes rods 18 projecting from the back surface of the plate into openings 12A and 13A formed within the side ribs 12 and 13, respectively. The rods 18 are located at spaced points along the length of the rib which, of course, corresponds to the length of the roof support. Rods 18 are also provided at upper and lower locations on plate 17 as shown in FIG. 1. The outwardly facing surface of the anchor plate 17 includes a plurality of relatively closely-spaced retainer bars 19. These retainer bars extend from the anchor plate in an upward direction toward the roof whereby upon elevation of the side edge of the roof support, the bars actually form ratchet teeth to receive and carry the edge of the roof support after emplacement with a desired prestressing force. In the embodiment of FIG. 1, the rods 18 of anchor plates 17 are emplaced into the openings 12A and 13A prior to the installation of the arched roof support. However, other forms of anchor means are disclosed for elevated movement along with the side edges of the arched roof support during the emplacement thereof. One such form of anchor means is shown in FIG. 2 wherein a narrow flanged I-beam 20 has holes to receive a carrier bar 21 secured to and extending between ribs 20A so as to support a carrier for the side edge of support plate 15. A serrated or sawtooth surface 22 is formed on the edge toe surfaces of the flanges 20B. The serrated or sawtooth edges facilitate penetrating engagement into the surface of the side ribs 12 and 13. In this way, the need for auxiliary support posts is optional depending, of course, on the surface condition and stratum forming the side rib at the elevation required for supporting the arched roof plate. It will be understood, of course, that support props 24 (FIG. 1) may be used to maintain the anchoring means and, hence, also the side edges of plate 15, at the desired elevation along the face surface of the side ribs. Roof bolts are also suitable for anchoring the side edges of the elastic arched roof support plate 15 with or without anchor plates. Because roof bolts are well known per se to those skilled in the art, it will be apparent that suitable openings along the side edges of plate 15 may be employed to secure the plate by roof bolts onto the mine roof. In a similar manner, openings in anchor plates may be used to secure them by roof bolts onto a side rib of a mine opening.

Figure 3:
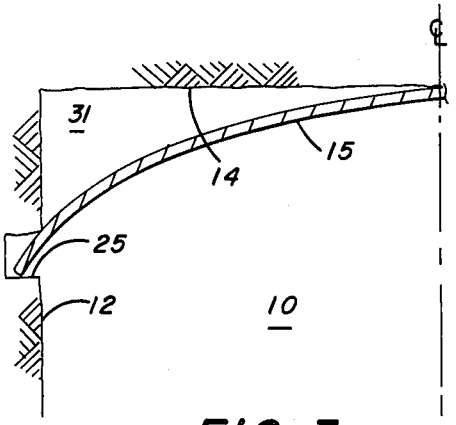
FIG. 3 is a partial, elevational view similar to FIG. 1 but illustrating a simplified support arrangement for an elastic arched roof support.

FIG. 3 illustrates a simplified form of support for the side edges of an arched roof support. The side ribs 12 and 13 each includes an elongated hollow slot 25 which is formed at an elevation along the side ribs corresponding to the desired elevation at which the side edge of the arched roof support plate 15 must be raised to provide the desired emplacement force.

FIG. 4 illustrates a further modification of an anchor wherein a lining for the upper portion of the mine opening is provided by plates 26 and 27 which extend along the roof and side ribs, respectively. While plate 26 extends across the width of the roof, plate 27 extends toward the floor preferably only below the coal shear failure line. Plates 26 and 27 are retained in place by studs or tangs 28 projecting from the side plate 27 into opening 12A as well as opening 13A in the side ribs 12 and 13, respectively. A similar tang or stud 29 extends into an opening 14B formed in the roof stratum. The top plate 26 may be further employed to carry a monorail 30 for a transportation system. The plate 26 has a bent edge extending downwardly below a slot provided in the arched roof support plate 15 where the extended end of plate 26 is connected to the monorail 30. The arched roof support is carried when emplaced with a prestressing force by outwardly projecting ribs from the side plates 27.

In each of the embodiments of the present invention, because of the arched nature of the roof support, it will be observed that two distinct free spaces normally exist between the surface of the plate 15 directed toward the roof and the immediate area adjoining the roof and side rib. Such spaces are denoted by the reference numeral 31 in FIGS. 1, 4 and 5. As shown only in FIG. 1, conduit pipes 32 are arranged to extend along one of the free spaces 31 for carrying therein communication lines or power supply lines. Moreover, by adhering to the exposed face surface of the plate 15, side rib 12 and roof 14, a layer of brattice cloth 33, a ventilation duct can be effectively provided within the other free space 31 to extend along the mine opening. Various configurations of the plate may be utilized to obtain a greater strength of material while reducing the weight of material forming the elastic arch.

Thus, the cross-sectional shape of a support plate can be rectangular or other regular shape. However, an irregular configuration to the cross-sectional shape will maximize the strength-to-weight ratio of the plate material so that the manual handling and emplacement of the elastic arch are facilitated. FIGS. 5 and 6 show two typical cross-sectional configurations which have improved handling and emplacement characteristics over a solid rectangular cross section. The limiting dimensions and specifications for the elastic roof support plate resolve to a minimal overall thickness which usually will not exceed 1 or 2 inches for maximum moment and minimum cross-sectional area. In FIG. 5, the roof support plate 35 has a corrugated cross section while the plate has a total thickness of between 1 to 1½ inches and a width of 12 inches. A modified configuration for corrugations is shown in FIG. 6 where the plate 36 in cross section is bent to form trapezoidally-shaped spaces at opposite sides of the plate. A preferred preselected curvature across the width of the support plate is a simple arch configuration generated about one or more radii at a common side of the roof support plate.

FIGS. 7–9 illustrate the manner by which an elastic arched roof support is arranged in an initial set-up position (FIG. 7) and then emplaced with a prestressing force against the middle portion of the roof (FIG. 8) according to the present invention. In FIG. 7, a beam-like anchor 38 is constructed in a manner similar to that already described in regard to FIG. 2 but includes an inwardly-bent upward end 39 that merges with the straight vertical section just above the point where openings 40 in the flanges are provided for receiving one or more rods 41 adapted to extend between the flanges of the beam. The end of the plate member 15 is received within a hooked end of a carrier 42. As shown, the hooked end is nested within a notch 43 formed by diverging plate members secured to a flat shoeplate 44 at spaced-apart locations. The free end of the carrier 42 has a reverse bend whereby the carrier member actually takes the form of an S-shape in cross section. The reverse bend of the carrier is received on a shaft 45 where it wraps partially around the shaft while passing between side plates 46 that form a bull-horn arrangement of parts on the rod end of a piston and cylinder assembly 47. This assembly includes a handle 47A to facilitate its emplacement within and transportation along the mine opening. The piston and cylinder assembly 47 is supported by a clevis mounted shoe 48 adapted for support by the mine floor. The piston and cylinder assembly may be energized pneumatically or by oil from a suitable controlled source thereof, not shown. With the apparatus of the present invention arranged in the manner just described in regard to FIG. 7, the fluid medium is controllably delivered to the piston and cylinder assembly 47 whereby the rod end is forcibly extended from the cylinder portion thereof and the force developed thereby is exerted against the carrier 42 which, in turn, slides the beam member upwardly along the side rib to a point where the upper end of the beam engages the roof. A rod 41, if it has not been previously emplaced to extend between the flanges of the beam, is then inserted to hold the emplaced prestressed arch in the desired position. This position is maintained through the agency of leg members 49 which are coupled through apertures in the web portions of the beam-like anchor 38 by eyelet members 49A. Thus, it can be seen that as the anchor 38 is elevated along the side rib of the mine opening, the leg members 49 slide along the floor of the mine opening and provide a supporting interconnection between the lower end of the anchor 38 and the mine floor after the anchor has been raised to the desired elevation which is shown in FIG. 8.

FIG. 10 illustrates one form of apparatus suitable for providing the preselected curvature across the width of the arched roof support plate. This apparatus essentially includes a three-roll bender having rolls 50 and 51 located at spaced-apart locations at one side of a passline for a plate 52 to undergo bending by a controlled force supplied against a roller 53 which is driven by a motor 54 at the other side of the passline. Suitable means, such as a hydraulic actuator or a screw jack, is used to control the position of roller 53 with respect to rolls 50 and 51 so that the desired curvature is imparted to the plate 52 as it is passed along in the gap between the rollers at opposite sides of the plate. This desired curvature is preferably parabolic and is produced by automatic adjustment of roller 53 in a manner wherein this roller is continuously moved toward and away from rolls 50 and 51. Shear knives 55, located at opposite sides of the plate, are supported and movable one relative to the other to effect a shearing of the plate after a desired width has passed between the three-roll bender. The desired width is calculated on the basis of the width of the mine opening. The desired width of the arched roof plate may be conveniently established by using roll 51 as a measuring roll having a preestablished peripheral surface whereby its rotation measured by counter 56 provides a signal to a numerical read-out display 57. A potentiometer 58, connected to the read-out display 57, provides a correcting factor corresponding to the distance between the shear knives 55 and the measuring roll 51. In this way, the read-out display provides a measure of the actual length of the material passed beyond the shear knives.

Figure 11:
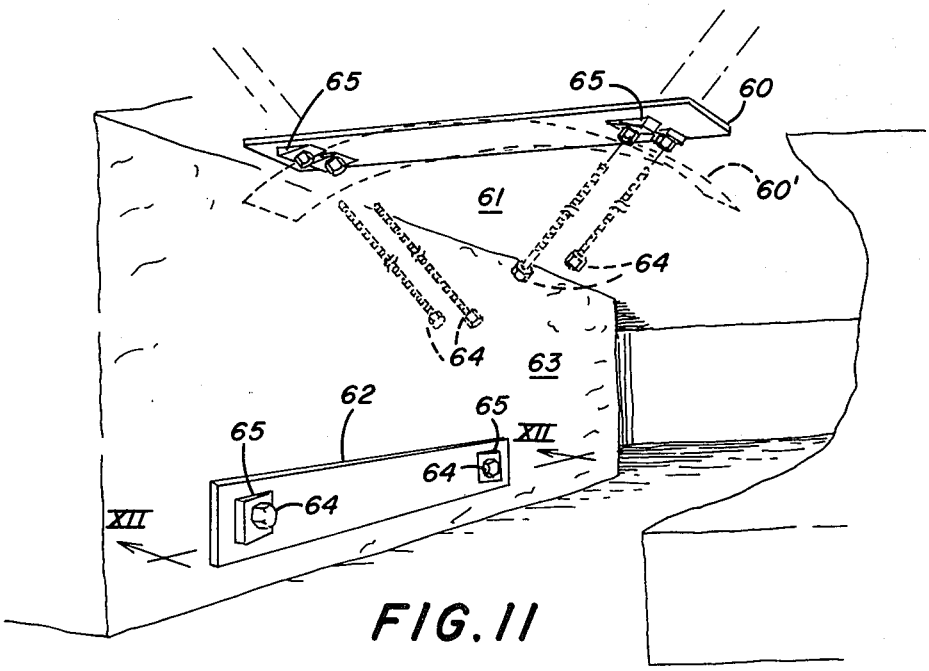
FIG. 11 is a perspective view showing the emplacement of elastic arched support plates upon the roof and a side rib of a mine opening.

FIG. 11 illustrates two further embodiments of the present invention wherein prestressed elastic arched supports are employed to support different wall surfaces of a mine opening. An elongated plate member 60 or 62 is selected with a preselected curvature along its length. The desired curvature in this aspect of the invention is preferably parabolic although, as described hereinbefore, other plate curvatures may be employed. The curvature of the plate extends along its length. The plate 60 is shown in an emplaced, load-bearing contact with the roof stratum 61 in the mine opening. The plate 62 is shown in an emplaced relation with the side rib 63 of the mine opening. The plate 62 is particularly useful in mine openings which are developed within relatively deep strata where heavy pressures on the rib line is severe. Plate 62 is used to prevent portions of the side rib to spall off under the pressure. This tendency of spalling is particularly accute at a short distance above the floor line because the rib material behaves as a plastic material in failure.

The plates 60 and 62 are each sufficiently lightweight so that they may be manipulated by a workman without the need of auxiliary machinery. Thus, for example, these plates preferably have a weight of about 60 to 70 pounds while the material used to form the plates has a sufficient tensile strength of, for example, between 50,000 to 150,000 PSI, preferably 80,000 PSI, to withstand the stresses imposed on the plate by elastic flattening thereof. Plate 60 or 62 consists of reinforced resin, hardened carbon steel, alloy steel or aluminum alloy materials. The width of the plates is typically within the range of 6 to 36 inches but preferably within the range of 12 to 14 inches while the length thereof is selected to meet the prevailing conditions of the wall surface in the mine opening. The required physical dimensions of the plates are determined beforehand to provide the required support for a surface of either the roof or the rib. A plate with the required dimensions is then cut from available stock material or selected from a plate stockpile. The plate is then further processed by forming a preselected curvature along the length of the plate which is calculated in a manner to produce the desired force upon the wall surface upon elastic flattening of the plate from the preselected curvature.

Figure 12:
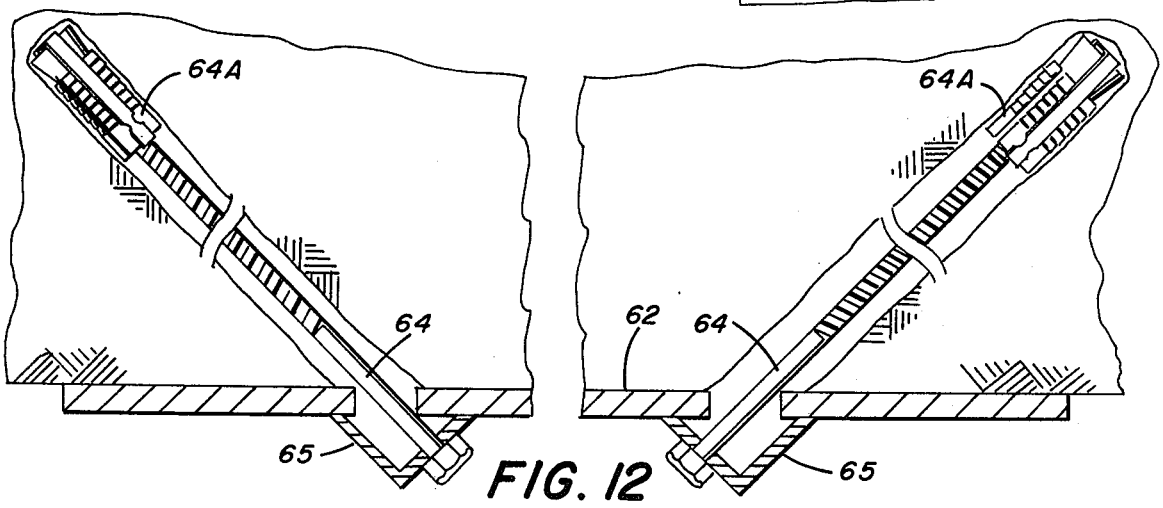
FIG. 12 is a sectional view taken along line XII—XII of FIG. 11.

As indicated in FIG. 11 by reference numeral 60', the select plate is first lifted into a position such that the midportion of the plate contacts the roof stratum of the mine opening. In this position the curved ends to the arch-shaped configuration to the plate are disposed remotely from the surface of the roof. Emplacement of the plate occurs by first passing one, two or even three roof bolts 64 through separate annular openings in the ends of the plates into previously prepared openings in the roof of the mine. Each of these openings extends at an angle of between 45° to 60° in the roof stratum or side rib so that the holes diverge with respect to the ends of the plate. As shown in FIGS. 11 and 12, between the head portion of the roof bolt and the plate itself, a square compression member 65 is used as a transition member to distribute the imposed deformation forces developed by the roof bolt upon the plate member. Each roof bolt is typically at least 4 feet long but a longer roof bolt may be used, e.g., up to 9 feet in length or even greater. Any of numerous devices may be used to anchor the roof bolt in place. One device is a metallic expansion anchor 64A. The roof bolts or torqued to a desired extent in the expansion anchor to impose the desired prestressing force upon the roof strata or side rib. The prestressing force is usually preselected to lie within the range of 400 pounds per foot to 2000 pounds per foot of length with preferred prestressing force being approximately 600 pounds per foot. The same emplacement procedure is carried out with regard to plate 62 together with roof bolts for attaching this plate to the rib surface of the mine opening. FIG. 12 illustrates the emplaced relation of the prestressed elastic arched support for the mine wall surface wherein it will be observed that the plate is flattened to the extent that it is returned almost completely to its flat planar configuration. However, in certain instances, the opposite ends of the plate may be curved slightly from the wall surface.

In place of the expansion anchor 64A, polyester resin may be used to anchor of roof bolt. Separate resin components in two plastic containers are first placed in the drilled roof or rib hole and then the resin components are mixed in situ by using the roof bolt to rupture and mix the contents of the containers by rotating the roof bolt. The resin then cures and hardens into a mass that anchors the bolt along its entire length. A still further form of suitable anchor device is generally referred to in the art as "point-anchor resin bolting". The same basic procedure is followed as in the use of polyester resin except the roof bolt is anchored only along one or two feet of the bolt's length. The bolt used for "point-anchor resin bolting" is preferably made in two pieces to allow for subsequent tightening of the bolt after the resin hardens.

Figure 13:
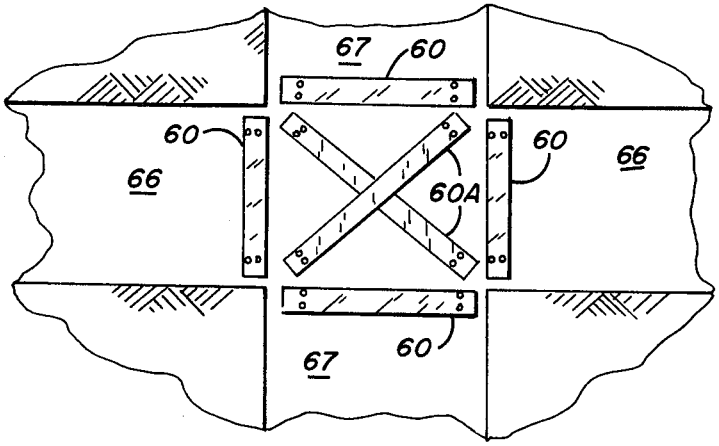
FIG. 13 is a plane view of a mine roof at an intersection of two tunnels showing emplacement of elastic arched support plates by roof bolts.

FIG. 13 illustrates the typical arrangement of prestressed elastic arched supoorts at the junction between two intersecting mine tunnels 66 and 67. In this regard, an arched support plate 60 spans the width of the roof surface at the point where each tunnel intersects. Additional support plates 60A are arranged in the form of an "X" such that the midportion of one plate 60A overlies the midportion of the first to be emplaced plate 60A. While it is contemplated that the roof bolts will form the sole means for establishing the prestressed elastic force upon the plates 60 or 62 during emplacement, it is nevertheless to be understood that other mechanical means may be used to elastically flatten the plates into the desired prestressed relation following which roof bolts or similar means may be used to retain the plate in its emplaced position under the deformation force established by the elastic flattening of the plate.

Although the invention has been shown in connection with certain specific embodiments, it will be readily apparent to those skilled in the art that various changes in form and arrangement of parts may be made to suit requirements without departing from the spirit and scope of the invention.

I claim as my invention:

1. A support for a surface of a mine opening, said support comprising a elongated plate member having a preselected downwardly-concave curvature along the length thereof and a sufficient tensile strength to withstand elastic flattening of the middle portion of the plate member from said preselected curvature into prestressed contact against the surface of the mine opening, and prestressing emplacement means including bolt members anchored in the mine strata to engage said plate member at distally-spaced points from the middle portion of said plate member to elastically flatten said plate member by compressively stressing a face surface thereof against the surface of said mine opening.

2. The support according to claim 1 further comprising a compression member between each of said bolt members and said plate member.

3. The support according to claim 2 wherein said compression member engages said plate to distribute imposed deformation forces developed by said bolt members, the bolt members at opposite ends of the plate member diverging along their projected length into the mine strata.

4. A support for the roof and side rib surfaces of a mine opening, said support comprising an elongated plate member having a preselected curvature along the length thereof and a sufficient tensile strength to withstand elastic flattening of the middle portion of the plate member from said preselected curvature into prestressed contact against the roof surface of the mine opening, and prestressing emplacement means engaging the ends of said plate member to at least maintain elastic flattening of the central curved portion of said plate member by compressively stressing a face surface thereof against the roof surface of said mine opening while developing a horizontal thrust by a reactive component to the prestressing force, said prestressing emplacement means being carried by side rib surfaces of the mine opening to impose said horizontal thrust against said rib surfaces for support thereof.

5. The support according to claim 4 wherein for each opposing side edges of said elongated plate member said prestressing emplacement means includes an elongated member having a retainer projecting on one face surface to engage a side edge of said plate member, and anchor means projecting at spaced-apart locations from the opposite face surface for support by a side rib of the mine opening.

6. The support according to claim 5 wherein said elongated ember includes a plate supported by a side rib of the mine opening while each such plate is adjoined by a further plate extending along the roof surface of the mine opening.

7. The support according to claim 4 wherein said prestressing emplacement means includes an I-shaped carrier beam having a web section including a retainer bar to position and carry a side edge of said plate member while at least partly supported by a side rib of the mine opening.

8. The support according to claim 7 further comprising actuator means to elevate a side edge of the plate member for prestressed emplacement of said plate member.

9. The support according to claim 8 further comprising a post member extending along each side rib between a side edge of said plate member and the floor of the mine opening for maintaining prestressed emplacement of said plate member by said actuator means.

10. The support according to claim 4 further comprising duct means carried by said plate member to extend along a face surface thereof within an open free space between the preselected curvature of said plate member and the roof of the mine opening.

11. A method for supporting the surface of a wall in a mine opening, said method including the steps of selecting a support plate having a desired width and a generally arch-shaped configuration along the length thereof, arranging the selected support plate such that the curved ends to the arch-shaped configuration curve outwardly from the surface of the wall in the same opening while the central midportion of the support plate contacts the surface of the wall in the mine opening, and elastically flattening the central midportion of the support plate along the width thereof against the surface of the mine opening by directing a force upon at least one end of the support plate in a direction toward the surface of the mine opening which contacts the central midportion of the support plate to thereby compressively stress the central midportion of the plate and emplace the support plate under prestressing force against the surface of the mine opening.

12. A method for supporting the roof stratus of a mine opening, said method including the steps of:

selecting a generally arch-shaped support plate having a desired length and a width reduced by the arched configuration thereof to approximately correspond to the distance between the side ribs of the mine opening, arranging the selected support plate such that the curved ends to the arch-shaped configuration curve downwardly from the roof stratum of the mine opening while the central midportion of the support plate contacts the roof stratum, elastically flattening the central midportion of the support plate along the length thereof against the roof stratum by directing a force upon at least one end of the support plate in a direction toward the roof stratum to thereby compressively stress the central midportion of the support plate and emplace the support plate under a prestressing force against the roof stratum while developing a horizontal thrust as a reaction component to the prestressing force, and using the side ribs of the mine opening to anchor the emplaced support plate while imposing said horizontal thrust on the side ribs to support at least part of the surfaces thereof.

13. The method according to claim 12 including the further step of arranging props to extend between the mine floor and the side edges of said support plate for supporting the latter after emplacement thereof.

14. The method according to claim 12 wherein said step of elastically flattening including applying upward forces to each of opposed ends of the support plate to compressively stress the central midportion of the plate and emplace the plate under prestressing force.

* * * * *